US005860459A

United States Patent [19]

Reed et al.

[11] Patent Number: 5,860,459

[45] Date of Patent: Jan. 19, 1999

[54] APPARATUS AND METHOD OF FILLING AN AUTOMATIC TRANSMISSION WITH WORKING FLUID

[75] Inventors: Bowu Reed, Ypsilanti Twp.; Christopher D. Porter, White Lake, both of Mich.

[73] Assignee: Chrysler Corporation, Auburn Hills, Mich.

[21] Appl. No.: 823,943

[22] Filed: Mar. 25, 1997

[51] Int. Cl.[6] ..... B65B 1/04; B65B 3/04

[52] U.S. Cl. ..... 141/198; 141/5; 141/192; 184/1.5

[58] Field of Search ..... 141/4, 5, 7, 98, 141/192, 198, 356; 184/1.5, 103.1, 105.1

[56] References Cited

U.S. PATENT DOCUMENTS 1,392,632 1/1921 Flanders .
1,471,238 10/1923 Burkhard .
2,326,251 8/1943 Piquerez .
3,590,890 7/1971 Young .
3,920,056 11/1975 Piecuch .
4,877,066 10/1989 Okamizu .
4,984,612 1/1991 Haye .
5,247,973 9/1993 Brown ..... 141/198
5,456,295 10/1995 Taylor et al. .
5,501,253 3/1996 Weiss ..... 141/198

*Primary Examiner*—Steven O. Douglas
*Attorney, Agent, or Firm*—Kenneth H. Maclean

[57] ABSTRACT

A top off fill wand assembly for adding and removing operating fluid from an automatic transmission for a vehicle having a flexible fluid fill line for snaking through a transmission fill tube which incorporates a tip assembly with a metal electrical contact at the tip. The contact of the tip with the bottom of the oil pan completes electrical circuitry activating top off operation. The tip has a port which corresponds to indicator stick level measurement system. If level is low, the fill wand delivers fluid to the sump until the port is reached, and if level is high, the wand removes fluid until the level is obtained.

5 Claims, 3 Drawing Sheets

APPARATUS AND METHOD OF FILLING AN AUTOMATIC TRANSMISSION WITH WORKING FLUID

TECHNICAL FIELD

This invention relates generally to a device to supply operating fluid to an automatic transmission with a torque converter, and more particularly, to a new and improved fluid fill control wand assembly which supplies fluid and alternately removes fluid for establishing a desired fluid level in the automatic transmission.

DESCRIPTION OF RELATED ART

Prior to the present invention, various fluid filling devices and methods have been devised to fill transmissions and the like with an operating fluid. In U.S. Pat. No. 5,456,295 for VEHICLE TRANSMISSION OIL FILLING APPARATUS AND METHOD, issued Oct. 10, 1995, to Taylor et al and assigned to the assignee of this invention and hereby incorporated by reference, a specialized transmission oil fill tube is provided in which a sealed adapter is employed at the upper end to effect filling of a transission sump with oil to a desired level. In this patent an air pressure device is used to sense changes in the fluid level of the transmission fluid until a predetermined level is reached. In U.S. Pat. No. 4,877,068, issued Oct. 31, 1989, for APPARATUS FOR FILLING TRANSMISSION FLUID INTO TRANSMISSIONS, an optical sensor and associated amplifier, are employed to sense the distance of the surface of the fluid from the end of a fluid dispensing device and to signal a controller to operate a fluid dispenser to effect the supply of fluid until a predetermined fluid level is obtained.

While the prior art discloses various constructions for adding and removing fluid from a transmission sump until a liquid level is obtained, they do not disclose or suggest the new and improved fill wand assembly of the present invention which automatically adds or removes fluid to produce a predetermined fluid level. The fluid level is precisely established by the wand assembly incorporating a portion making direct contact with a fixed datum point such as the interior surface of the transmission sump wall. More particularly, the prior art devices and methods do not provide the fluid fill accuracy and consistency of the present invention since the desired fluid level are generally determined from bench marks or start points that vary from transmission to transmission.

SUMMARY OF THE INVENTION

In contrast to the prior art constructions, the filling wand assembly of the present invention employs a resilient and flexible oil feed conduit or tube which can be easily routed through elongated and often curved fill tubes of varying lengths (from sump to top of fill tube) as installed on many conventional transmissions. The oil feed line of the wand assembly is flexibly connected to a distal fill tip assembly that is positioned at a predetermined location within the fluid sump of the transmissions. The tip assembly has an electrically conducting end which contacts a fixed part of the transmission, such as the bottom surface of the sump pan, to establish a consistent datum base for fill levels and to complete an electrical circuit for activating fill controlling apparatus such as a pump. In addition to the contact end, the tip assembly of the fill wand assembly has a pressure sensing apparatus used with a fluid level establishing port that detects a pressure change when the port is covered or uncovered by the fluid within the sump so as to operate a corresponding reversible pump to either add fluid to or subtract fluid from the transmission sump until a predetermined fluid level is obtained.

In the present invention, a tubular air flow line is connected to the fluid level sensing port which is located at a fixed axial location in the tip assembly and therefore a fixed desired distance from the bottom of the transmission sump. Both air and oil feed lines are encased and shielded by an upper hood and body member and an intermediate fill tube sensing collar which depends from the body member. From the end of the sensing collar the oil feed line, with the level indicating air line inside, is adapted to snake through the transmission's metallic fill tube. Contact of the sensing collar with the fill tube and the touching of the contact end of the tip assembly with the sump pan establishes control circuit for energization of pump controls that effects operation of a reversible pump to initiate a filling sequence until a desired fluid level is obtained.

BRIEF DESCRIPTION OF THE DRAWINGS

FIG. 1 is a pictorial view of a portion of an automatic transmission for a vehicle with a convention fill tube and dip stick leading into the transmission oil sump there for;

FIG. 2 is an enlarged pictorial view of the fill tube and a dip stick assembly partially inserted into the fill tube and sump with portions broken away;

FIG. 3 is a pictorial view similar to FIG. 2 but with the dip stick removed from the fill tube and replaced by a fluid fill wand of the present invention;

FIG. 7 is a cross-sectional view taken along line 7—7 of FIG. 6.

DETAILED DESCRIPTION OF THE PREFERRED EMBODIMENT

Figures 1, 2, 3, 7:
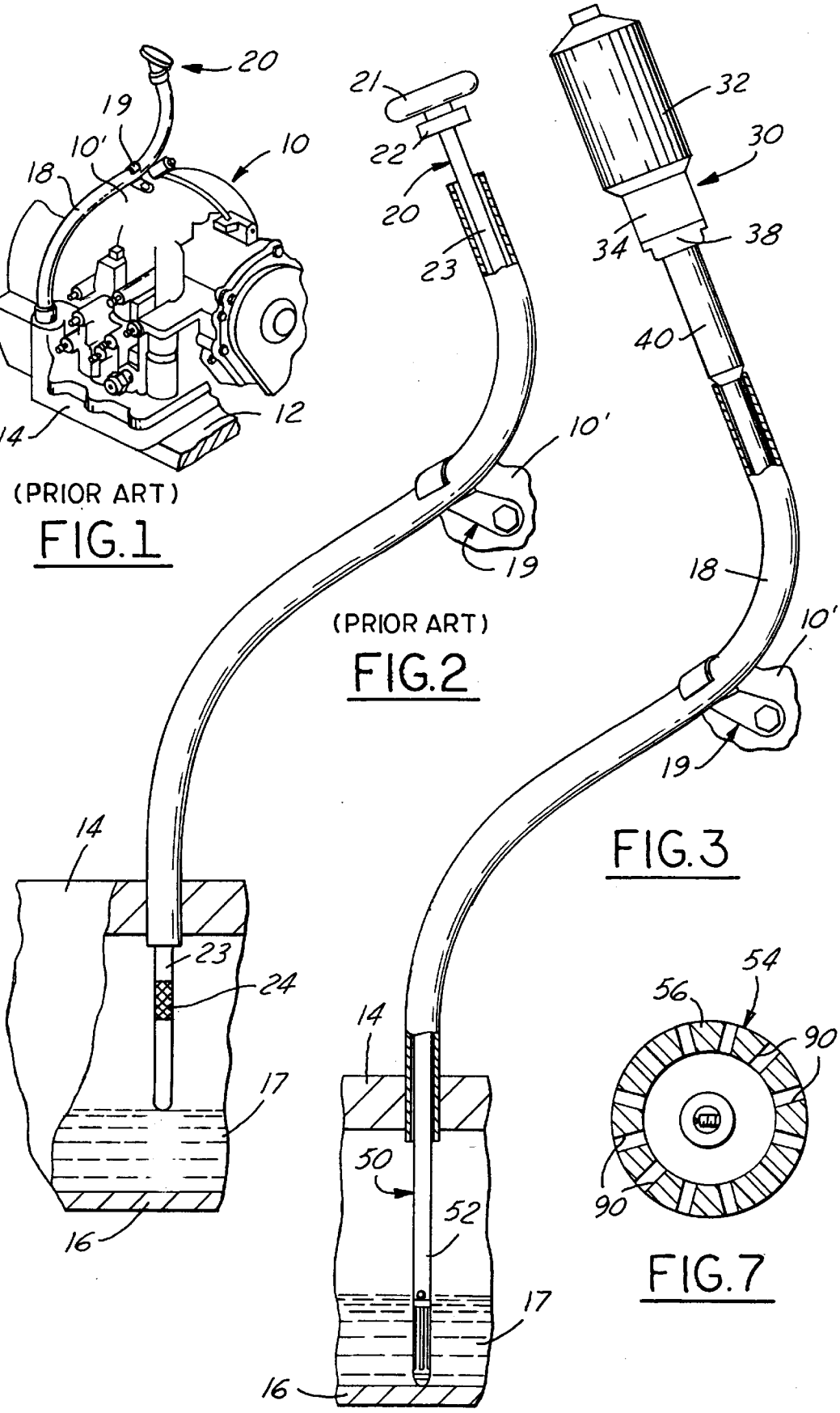
(PRIOR ART) FIG.1
(PRIOR ART) FIG.2
Figure 4:
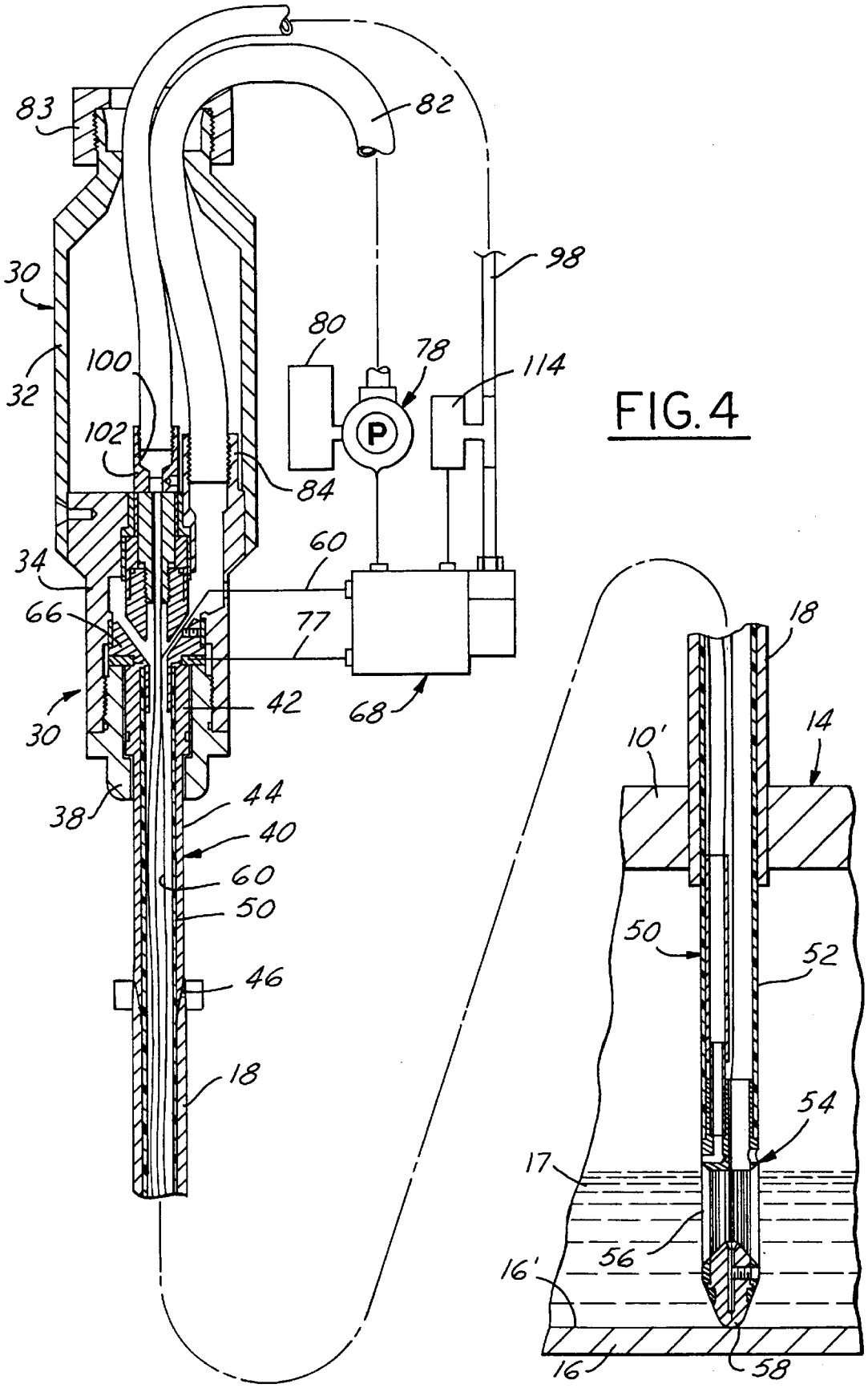
FIG. 4 is an enlarged cross-sectional view of the fluid fill wand and fill tube of FIG. 3 with an associated fluid fill pump and controls shown diagrammatically.
Figure 5:
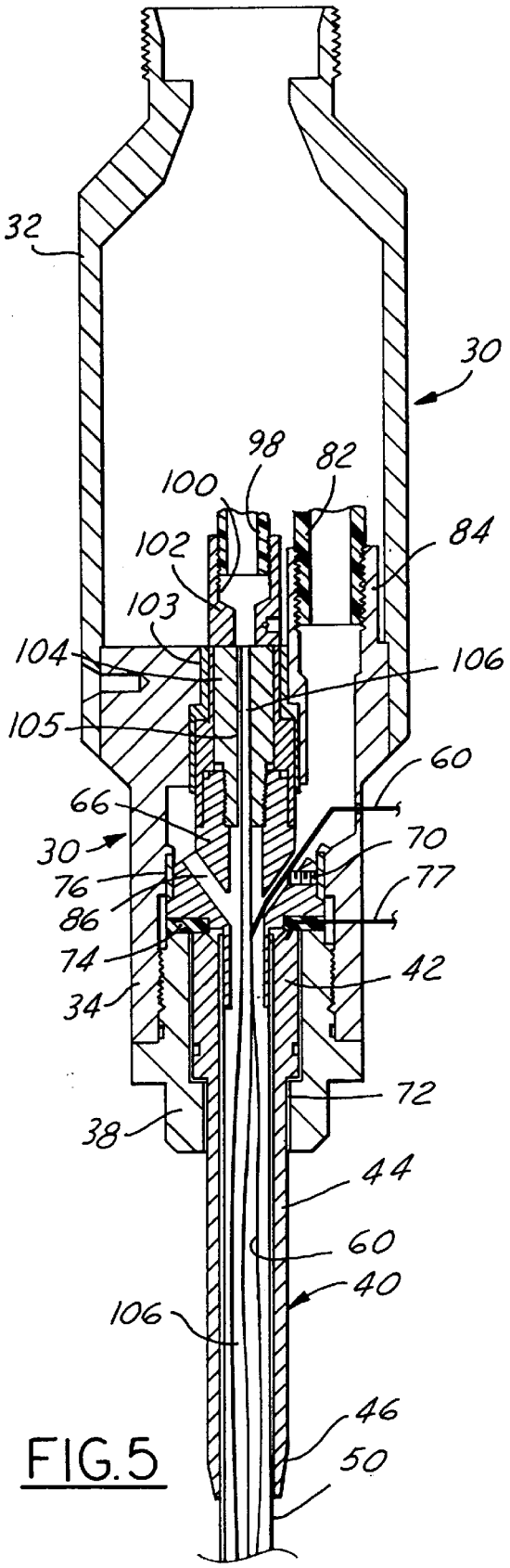
FIG. 5 is an enlarged cross-sectional view of an upper portion of the fluid fill wand.

Turning now in detail to the drawing, FIG. 1 shows a portion of a hydrodynamic automatic transmission 10 mounted to a support structure 12 of a vehicle such as a truck, for example. The transmission 10 includes a torque converter assembly (not visible) which also is a fluid operated device. The housing 10' of transmission 10 defines a fluid sump portion 14 which is closed at the lower portion by a conventional metallic bottom wall or pan 16 as is seen in FIGS. 2–4. The sump portion 14 including pan 16 provides a reservoir for transmission operating fluid, i.e. oil needed for operation of the torque converter and transmission to effect vehicle movement and changes in speed.

Hydrodynamic transmissions typically have elongated metallic fill tubes 18 which are connected at a lower end portion through a wall of the transmission sump 14. The fill tube 18 usually must takes a circuitous and curved route upward from the sump 14 to an open upper end portion. The open upper end portion is supported by attachment to the transmission housing 10' by a bracket and fastener assembly 19. With this arrangement, the fill tube 18 provides a passage or tube for the entry or exit of fluid in the transmission's sump portion. The upper opening of the fill tube is conveniently located in a vehicle engine compartment so that transmission fluid can be readily added to the transmission as required.

As shown in FIG. 2, the fill tube 18 normally supports an elongated dip stick assembly 20 inserted therethrough. The assembly 20 has a handle portion 21 and a fill tube closure cap portion 22 attached to the upper end. The assembly 20 also has an elongated flexible blade portion 23 which is insertably extended into and through the fill tube 18 where its lower end extends into the transmission sump 14. As is known, the dip stick assembly 20 can be removed from its installed position in fill tube 18 for checking the fluid level of transmission oil in the sump. Fluid clinging to the blade portion 23 as related to conventional markings 24 on the blade indicate the liquid level in the sump so that transmission oil can be added as necessary.

During vehicle assembly, the vehicle chasis moves along an assembly line for installation of an engine and transmission. Subsequently, the transmission is filled with operating fluid to a desirable level. The present invention is directed to a new and improved fluid fill instrument and method to improve assembly efficiency and provide an more optimized fluid level for each transmission. The instrument automatically adds transmission fluid to the transmission sump and removes excess fluid if necessary for establishing a predescribed desired fluid level.

A preferred embodiment of the filling instrument is illustrated in FIGS. 3–6 in the form of a fill wand assembly 30. The fill assembly 30 includes an upper portion including a cylindrical hood member 32 which is sized and configured for being manually gripped to allow ready insertion into a fill tube 18. From the hood portion 32, a generally cylindrical body member 34 extends. Specifically, body member 34 is fastened to and extends axially from a lower end potion of the hood member 32. A retainer cap 38 is attached to a lower portion of the body member 34 by a threaded connection or some other suitable security means.

The retainer cap 38 secures an elongated and tubular positioning and sensor member 40 to body member 34. The positioning and sensor member 40 has an enlarged cylindrical head portion 42 held to body member 34 by the retainer cap 38. An elongated and tubular shank portion 44 of member 40 extends through an annular opening defined in the retainer cap member 38 and has a tapered distal end portion 46 which is adapted to engage the upper end opening in the fill tube 18 after the assembly 30 is insertably positioned within the fill tube 18.

An upper end portion of a flexible tube 50 for transmitting oil is secured within the tubular sensor member 40. The oil passage tube 50 extends out from the sensor tube 40 and terminates with a remote distal end portion 52 as is best seen in FIG. 4. The end portion is attached to an outlet tip assembly 54. The outlet tip assembly 54 is insertably and frictionally attached to the lower end portion 52 of the oil passage tube 50. Tip assembly 54 is configured so as to allow ready insertion into the oil fill tube 18 and includes a generally cylindrical body portion 56 of nylon or other suitable elastomeric material and an end contact 58 of titanium or other suitable electrically conductive material.

Figure 6:
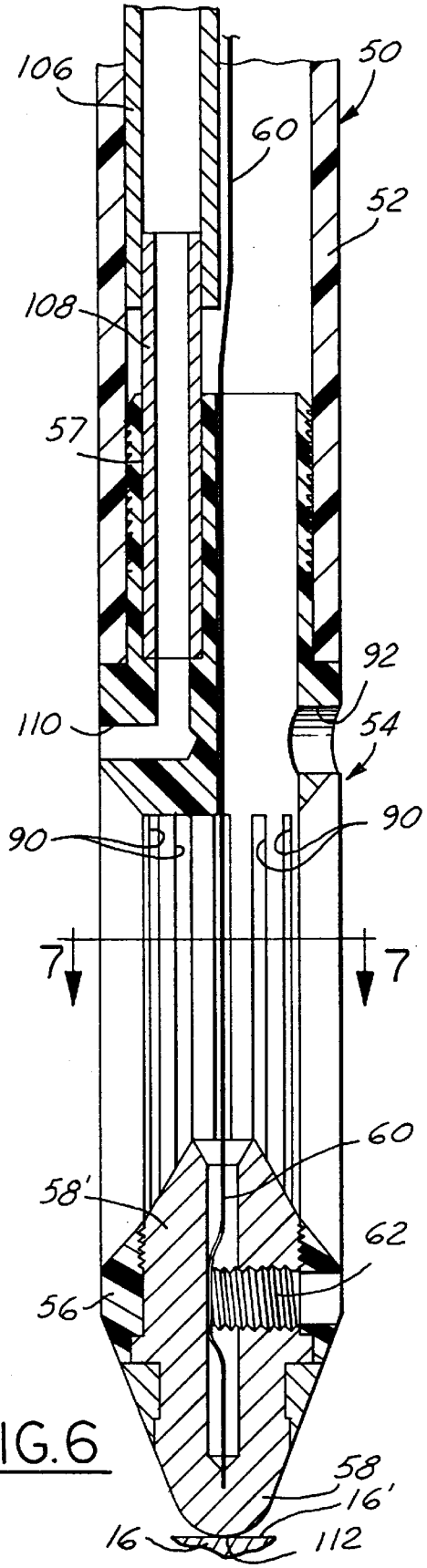
FIG. 6 is further enlarged cross-sectional view of the lower portion of the fluid fill wand.

As best shown in the enlarged FIG. 6, the contact tip 58 of the tip assembly has a neck portion that is insertably and frictionally engaged with a corresponding lower end portion of the body 56. The contact is adapted to physically engage the inner surface 16' of the pan wall 16 so that an electrical circuit can be completed there between as is shown in FIG. 3, 4 and 6. The closing of the circuit in association with other components to be described hereafter initiates operation of a control assembly and an associated transmission fluid pump to automatically add fluid to or subtract fluid from the transmission sump.

More specifically, in association with the contact tip 58, the aforementioned circuit includes an elongated wire or conductor 60 leading from its connection with the contact tip 58 which is established by a set screw 62. The conductor wire 60 is routed from the tip 58 through the flexible oil transmitting tube 50, then through insert member 66 which is mounted within the body member 34. As shown somewhat diagrammatically in FIG. 3, wire 60 then extends through the side of the body member in a sealing manner to a control assembly 68. An upper set screw 70 secures conductor wire 60 to the insert member 66 and an insulating coating 72 and a non-conductive washer 74 insulate the fill tube sensor 40 from the cap member 38 and from the insert member 66. Also an insulating sleeve 76 is positioned between the insert and the body 34 as shown.

As previously stated, circuit components other than the tip 58 and wire 60 are involved for activation of the control assembly 68. Specifically as shown in FIG. 4, the previously mentioned engagement of the distal end portion 46 of the fill tube sensor member 40 with the upper end portion of the metallic fill tube 18 complete a circuit with the control assembly 68 by means of wire conductor 77. The electrically conductive metal fill tube 18 and the metal transmission housing including wall 16 complete the circuit. The wire conductor 77 is operatively and electrically connected to sensor member 40 through the insulative washer 74 as best seen in enlarged FIG. 5.

Upon closing of the above described circuit, the control assembly 68 initiates operation of an electrically powered reversible fluid pump 78 which pumps transmission fluid from a reservoir 80 into the transmission sump 14 when in a first mode of operation and, alternately, which pumps fluid from the sump 14 back into the reservoir 80 when in a second mode of operation. As shown in FIG. 4, an elongated flexible hose 82 is routed from the outlet of the pump 78 through fittings 83, 84 associated with members 32 and 34, respectively. The transmission fluid flows through hose 82 and then is routed through passages 86 formed in the insert member 66. The fluid then flows through tube 50 to the fluid dispensing body 56 of the tip assembly 54 as perhaps best illustrated in FIG. 6.

As shown best in FIGS. 4, 6 and 7, the dispensing tip body 56 is a generally cylindrical member that has a plurality of equally spaced and elongated fluid flow slots 90 formed therein. This circumferential arrangement of slots promotes an orderly flow of transmission fluid to the sump with minimized turbulence and frothing. In addition to slots 90, a radial or transverse fluid flow port 92 is provided in the tip body adjacent to the end of the oil transmitting tube 50 for increasing the capacity of oil flow into and out of the sump.

An air pump 96 is provided as seen in FIG. 4 in addition to the fluid pump 78. The air pump 96 has an associated pressure regulating valve assembly 97 operated with the control assembly 68 to provide a source of pressurized air that is fed through a flexible air feed line or hose 98 to an entrance 100 of an air tube port post 102 within member 34, as shown best in FIGS. 4 and 5. The air tube port post 102 is mounted within an insulative bushing 103 within member 34. The air tube post 102 encases a cylindrical and centralized air tube fitting 104. This fitting has a threaded and axially extending neck 105 which threads into the insert member 66.

An elongated air tube 106 made of a suitable elastomeric material extends from the entrance 100 of the port post 102 through a central passage in the air tube fitting 104, through insert member 66, and then through the oil transmitting tube 50. As best shown in FIG. 6, the air tube 116 terminates at a connection with a tubular pipe 108 that itself fits into the top portion 57 of the wand tip body 56 of assembly 54. The pipe member 108 opens into a sensing port 110 which extends radially in the wand tip body 56 and is spaced a predetermined distance from the end most extremity 112 of contact tip 58. This spatial relationship establishes the desired height or depth of transmission oil within the sump.

With the aforedescribed construction, air pump 96 is operatively connected with the sensing port 110 to cause a flow of air at a regulated pressure to be supplied through port 110. The control assembly 68 include a pressure sensor device 114 connected in the tube 98 to sense changes in pressure at sensing port 110 relative to the regulated pressure so that the control assembly 68 directs an appropriate operation of the reversible pump 78 to either add or remove transmission fluid from the sump in accordance with the desirable fluid level therein.

In operation, when the fill wand assembly 30 is inserted into a transmission fill tube 18 and is activated, the sensing member 40 engages the top of the fill tube at about the time the contact tip 58 engages the bottom 16' of the pan 16. The engagement of the distal end portion 46 of the fill tube sensor 40 with the top of the fill tube 18 completes a circuit to the control assembly 68. The tip 58 and wire 60 completes a circuit to the control assembly 68. Resultantly, the controls receive signals from the pressure sensor to effect operation of the air pump and of the fluid fill pump 78 for a fluid filling operation.

If the sensor 114 senses that there is increased pressure at the sensing port 110, the pump is operated to remove fluid from the sump 14 through the tip assembly 54. The fluid flows through the hose 52 back to the reservoir 80. If the sensor 114 senses a relatively low pressure, the control assembly operates the pump in a manner to pass fluid from the reservoir 80 into the sump 14 until the level reaches the sensing port at which time the sensor 114 terminates the filling operation. Subsequently, the wand assembly is removed from the fill tube 18 which breaks the circuit continuity. Accordingly, the appropriate amount of fluid is supplied to the sump with the bottom of the pan providing a fixed datum plane for the fluid level sensed by the sensing port.

While a preferred embodiment of the invention has been shown and described, other embodiments will now become apparent to those skilled in the art. Accordingly, this invention is not to be limited to that which is shown and described but by the following claims.

What is claimed is:

1. A fluid fill control wand assembly with a fluid reservoir and control system for supplying and removing transmission fluid with respect to the fluid sump of an automatic transmission through an elongated fill tube associated therewith comprising a body member, an elongated sensing member supported by said body member and extending therefrom to a distal contact end for contact with the end of the fill tube, an elongated flexible transmission fluid conducting tube supported by said sensing member and extending therefrom for routing through the fluid fill tube, a tip secured to the end of said fluid conducting tube for operative connection to said fluid reservoir control system, said tip having a fluid sensing port therein, and an air line extending through said fluid conducting tube from said sensing port for connection to the control system.

2. A fluid level control wand assembly associated with a fluid supply and a fluid pump and electrical pump controls for adding and removing fluid from a fluid sump of a hydrodynamic transmission through an elongated fluid fill tube leading from a fluid entrance port thereof into the sump, said wand comprising a body member, a fill tube sensing member extending from said body member for insertion into the entrance port of the fluid fill tube, a flexible fluid transmission line supported by said body member and said sensing member and extending axially from said sensing member for insertion through said fill tube into said sump, a wand tip assembly secured to the end of said fluid fuel transmission line having fluid flow ports therein for adding and removing fluid from said sump and having at least one liquid level sensing port therein, an electrical lead routed from said tip assembly through said flexible fluid transmission line to said controls, and an air tube extending from said liquid level sensing port through said fluid transmission line for operative connection to the controls.

3. A top off fill wand assembly associated with a reservoir and a fluid pump and electrical controls for adding and removing operating fluid through a transmission fluid fill tube from the fluid sump of an automatic transmission for a vehicle comprising a body member, a flexible tubular fluid transmitting member secured to said body member and extending therefrom for snaking completely through said transmission fluid tube to the fluid sump thereof, a tip assembly carried at the end of said tubular fluid transmission member, and an electrical contact at the end of said tip assembly for contact with the bottom of said sump to effect operation of said controls and said pump.

4. A method of establishing an optimized operating fluid level in a sump of a hydrodynamic change speed power transmission for vehicles having a transmission fluid fill tube with an upper fluid entrance opening spaced from said sump and a lower fluid exit opening communicating with said sump comprising the steps of:

a. inserting an elongated fluid fill wand into said fluid fill tube until spaced contact points on said sump and said fill tube have been contacted by said wand to establish a fixed point of liquid level within said sump and continuity of an electric control circuit associated with a fluid pump to pump fluid to and from said sump, b. adding fluid into said sump when said level is below the level of said fixed point of liquid level and removing fluid from said sump when the level is above the level of said fixed point, c. automatically terminating the supply and removal of said fluid to and from said sump when said level is at said fixed point, and d. removing said wand from said fill tube.

5. A method of operating fluid fill controls to provide an optimized operating fluid level in a sump of a hydrodynamic change speed power transmission for vehicles having a transmission fluid fill tube with an upper fluid entrance opening spaced from said sump and a lower fluid exit opening communicating with said sump comprising the steps of:

a. inserting an elongated fluid fill wand into said fluid fill tube until spaced electrical contact points on said sump and said fill tube have been contacted by said wand to establish a fixed point of liquid level within said sump and the continuity of an electric control circuit associated with said fluid fill controlling fluid pump to pump fluid to and from said sump, b. automatically adding fluid into said sump through said wand when said level is below the level of said fixed point of liquid level and removing fluid from said sump when the level is above the fixed point of liquid level, c. automatically terminating the supply and removal of said fluid to and from said sump through said wand when said level is at said fixed point, and d. removing said wand from said fill tube to break the continuity of said circuit.

* * * * *